US005301895A

United States Patent [19]

Sheehan et al.

[11] Patent Number: 5,301,895

[45] Date of Patent: Apr. 12, 1994

[54] YARN TENSIONING APPARATUS

[75] Inventors: Richard W. Sheehan, Johnson City; Joseph L. Magner, Bristol, both of Tenn.

[73] Assignee: Intronics, Inc., Johnson City, Tenn.

[21] Appl. No.: 56,743

[22] Filed: May 4, 1993

Related U.S. Application Data

[62] Division of Ser. No. 868,514, Apr. 15, 1992, Pat. No. 5,238,202.

[51] Int. Cl.[5] ..... B65H 59/22; H01F 7/08

[52] U.S. Cl. ..... 242/150 M; 335/255

[58] Field of Search ..... 242/150 M, 150 R, 149, 242/147 M, 147 R, 45; 335/238, 255, 257, 258, 261

[56] References Cited

U.S. PATENT DOCUMENTS

| | | | |
|---|---|---|---|
| 3,207,961 | 9/1965 | Lohr | 335/255 |
| 3,303,445 | 2/1967 | Flentge | 335/255 |
| 3,381,250 | 4/1968 | Weathers | 335/255 |
| 3,400,351 | 9/1968 | Flentge . | |
| 3,681,942 | 8/1972 | Bassist . | |
| 3,685,267 | 8/1972 | Landwehrkamp et al. . | |
| 3,724,409 | 4/1973 | Olney, Jr. . | |
| 3,742,407 | 6/1973 | Cardew et al. . | |
| 3,805,204 | 4/1974 | Petersen | 335/258 X |
| 3,987,385 | 10/1976 | Diller et al. | 335/258 |
| 4,166,423 | 9/1979 | Brienza . | |
| 4,215,641 | 8/1980 | Dobrjanskyj et al. . | |
| 4,252,296 | 2/1981 | Berg . | |
| 4,313,578 | 2/1982 | Van Wilson et al. . | |
| 4,578,604 | 3/1986 | Eilertsen . | |
| 4,632,155 | 12/1986 | Maina . | |
| 4,745,386 | 5/1988 | Pawlak . | |
| 4,862,127 | 8/1989 | Lundstrom et al. . | |

*Primary Examiner*—Stanley N. Gilreath
*Attorney, Agent, or Firm*—Larson & Taylor

[57] ABSTRACT

The present invention provides a solenoid including an electrically conductive coil and a plunger located axially within the coil. The plunger is moved in an axial direction within the coil when the coil is energized. The motion of the plunger in the axial direction in the coil at a position such that, when the plunger is moved to the position by energizing the coil, the force exerted by the plunger is linear with respect to the electric power supplied to the coil.

The present invention also provides yarn tensioning apparatus employing a number of yarn tensioning devices using such a solenoid. A control system, including a special device for sensing the tension exerted on the yarn, allows each of the yarn tensioning devices in the apparatus to be individually and automatically controlled. The present invention also provides a method for individually controlling the tension exerted on each yarn either manually or automatically.

11 Claims, 8 Drawing Sheets

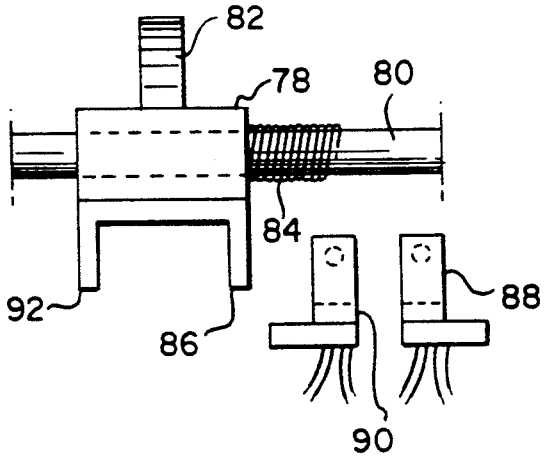
FIG. 9
FIG. 10
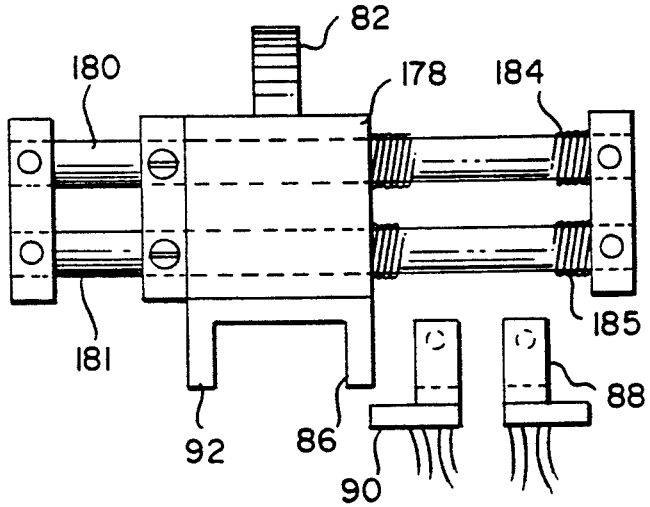
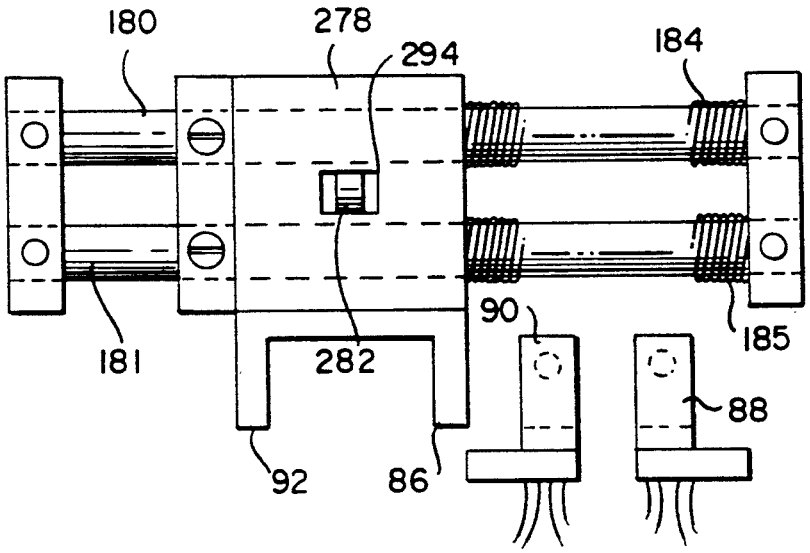
FIG. 11

YARN TENSIONING APPARATUS

BACKGROUND OF THE INVENTION

This application is a division of co-pending application Ser. No. 07/868,514, filed Apr. 15, 1992, now U.S. Pat. No. 5,238,202.

FIELD OF THE INVENTION

The present invention relates generally to a yarn tensioning apparatus. In one aspect, the present invention relates to a solenoid useful in yarn or filament tensioning devices. In a second aspect, the present invention relates to a yarn or filament tensioning device employing such a solenoid. In a third aspect, the present invention relates to an apparatus comprising a plurality of yarn tensioning devices and to systems for controlling the plurality of devices. In a fourth aspect, the present invention relates to devices for determining the tension exerted on a filament or yarn.

Prior Art

A typical yarn tensioning device for tensioning a running length of yarn includes a pair of adjacent confronting yarn engaging members which are forced into engagement with the yarn by means of a solenoid. Generally in textile processing, a large number of such yarn tensioning devices are used together to process many strands of yarn simultaneously.

There is widespread dependence of overall quality in most textile processing on the precision or uniformity of tension of the individual yarn ends. Once yarn tension control is lost or allowed to vary at any point of the process, whether winding, beaming, texturizing, knitting or other fabric formations, it is difficult or impossible to compensate for the quality degeneration. Streaking, barre, off yield, excessive knitting defects, denier variation are familiar problems that frequently have their origin in incorrect or uncontrolled tension on the individual yarn strands.

In order to control the tension on the yarn, it is necessary to have control over the solenoid causing tension to be exerted on the yarn. However, most solenoids are designed to generate the maximum force possible at the end of their stroke. Because the force exerted by the solenoid increases rapidly at the end of its stroke, it is difficult to control the force exerted by the solenoid and the tension applied to the yarn.

SUMMARY OF THE INVENTION

It is an object of the present invention to provide a solenoid in which the force exerted by the plunger of the solenoid is linear with respect to the electric power supplied to the solenoid when the plunger is at a predetermined, arrested position in the solenoid.

It is another object of the present invention to provide a filament tensioning device in which the filament tension is easily controlled.

It is another object of the present invention to provide tensioning apparatus in which the tension exerted on each filament or yarn can be individually controlled for each solenoid in the apparatus, even when the solenoids are powered by a common power source.

It is another object of the present invention to provide a system for individually controlling a plurality of filament tensioning devices.

It is another object of the present invention to produce high output tensions using extremely low power.

In one embodiment, the present invention provides a solenoid comprising:

a housing having an elongate channel for receiving a plunger;

an electrically conductive coil surrounding said channel;

means for varying electrical power supplied to said electrically conductive coil;

a plunger located axially within said coil, said plunger being moveable in an axial direction within said channel when said coil is energized, said housing having a seat for seating of a plunger in a seated position in said channel when said coil is energized, the force exerted by a seated plunger, on energizing said coil, not being linear with respect to the electrical power supplied to said coil;

means for arresting the motion of said plunger in said axial direction in said coil at an arrested position, said arresting means preventing a plunger from being fully seated in said channel, a plunger in said arrested position being sufficiently spaced from said seat in a direction opposite to said axial direction such that, when said plunger is moved to said arrested position by energizing said coil, the force exerted by said plunger is linear with respect to the electrical power supplied to said coil.

In another embodiment, the present invention provides a filament tensioning device comprising:

means for guiding a filament for motion in a path;

a first filament engaging member having a filament engaging surface for contacting the filament moving in the path;

a second filament engaging member having a second filament engaging surface for contacting a filament moving in the path;

at least one of the filament engaging members being movable relative to the other to cause the engaging surfaces to be in filament engaging position to restrain the motion of the filament moving in the path;

and a solenoid for moving the at least one movable filament engaging member, the solenoid comprising, a housing having an elongate channel for receiving a plunger;

an electrically conductive coil surrounding said channel;

means for varying electrical power supplied to said electrically conductive coil;

a plunger located axially within said coil, said plunger being moveable in an axial direction within said channel when said coil is energized, said housing having a seat for seating of a plunger in a seated position in said channel when said coil is energized, the force exerted by a seated plunger, on energizing said coil, not being linear with respect to the electrical power supplied to said coil;

means for arresting the motion of said plunger in said axial direction in said coil at an arrested position, said arresting means preventing a plunger from being fully seated in said channel, a plunger in said arrested position being sufficiently spaced from said seat in a direction opposite to said axial direction such that, when said plunger is moved to said arrested position by energizing said coil, the force exerted by said plunger is linear with respect to the electrical power supplied to said coil.

In another embodiment, the present invention provides apparatus for tensioning a plurality of filaments comprising:

means for guiding the movement of a plurality of discrete filaments in a plurality of discrete filament paths; and a plurality of filament tensioning devices, each of the filament tension devices being mounted in the apparatus for tensioning each of the discrete filaments, each of the filament tensioning devices comprising:

a first filament engaging member having a filament engaging surface for contacting a filament moving in a respective one of the plurality of discrete filament paths;

a second filament engaging member having a second filament engaging surface for contacting the filament moving in the respective discrete filament path;

at least one of the filament engaging members being movable relative to the other to cause the engaging surfaces to be in a filament engaging position to restrain the motion of the filament moving in the path; and a solenoid for moving the at least one movable filament engaging member, the solenoid comprising, a housing having an elongate channel for receiving a plunger;

an electrically conductive coil surrounding said channel;

means for varying electrical power supplied to said electrically conductive coil;

a plunger located axially within said coil, said plunger being moveable in an axial direction within said channel when said coil is energized, said housing having a seat for seating of a plunger in a seated position in said channel when said coil is energized, the force exerted by a seated plunger, on energizing said coil, not being linear with respect to the electrical power supplied to said coil;

means for arresting the motion of said plunger in said axial direction in said coil at an arrested position, said arresting means preventing a plunger from being fully seated in said channel, a plunger in said arrested position being sufficiently spaced from said seat in a direction opposite to said axial direction such that, when said plunger is moved to said arrested position by energizing said coil, the force exerted by said plunger is linear with respect to the electrical power supplied to said coil.

In another embodiment the present invention provides a control circuit for controlling the duration of the duty cycle of a solenoid based upon the tension exerted on a filament, the circuit comprising:

a power supply;

means for generating a reference current signal corresponding to a given tension upon a filament;

means for measuring the tension exerted on the filament;

means for generating a measured tension current signal based on the measured tension exerted on the filament;

means for generating an error signal corresponding to the difference between the reference current signal and the measured tension current signal; and means for incrementing or decrementing the duty cycle of the solenoid based upon the error signal.

In another embodiment the present invention provides a filament tensioning apparatus for tensioning a plurality of filaments comprising, a plurality of yarn tensioning devices, each the yarn tension device including, means for moving a filament in individual filament paths, a tensioning means for placing the filament under tension, a solenoid for controlling the tension effected by the tensioning on the filament, the solenoid controlling the effected tension by exerting force on the tensioning means, a control circuit for controlling the duration of the duty cycle of the solenoid based upon the tension exerted on the filament, the circuit comprising:

a power supply;

means for generating a reference current signal corresponding to a given tension upon the filament; means for measuring the tension exerted on the filament;

means for generating a measured tension current signal based on the measured tension exerted on the filament;

means for generating an error signal corresponding to the difference between the reference current signal and the measured tension current signal; and means for incrementing or decrementing the duty cycle of the solenoid based upon the error signal.

The present invention also provides a method for tensioning a plurality of filaments comprising:

moving a plurality of filaments in respective discrete filament paths;

activating a plurality of solenoids to exert force on a plurality of respective tensioning means which in turn apply tension to each of said plurality of filaments;

measuring the tension on said plurality of filaments;

comparing the measured tension on each of said filaments with a reference tension; and incrementing or decrementing the duty cycle of each of said solenoids based upon the difference between the measured tension for each respective filament and the reference tension to thereby adjust the tension exerted on each of said filaments.

In another embodiment, the present invention provides a device for sensing the tension exerted on a filament comprising:

shaft means extending through a sliding assembly, the sliding assembly sliding on the shaft means, the sliding assembly including a smooth member for engaging a filament, the filament sliding on the smooth member;

movement detection means for determining the amount of movement of the sliding assembly; and spring means for resisting movement of the sliding assembly when a filament engaging the pulley means pulls the sliding assembly in a given direction.

BRIEF DESCRIPTION OF THE DRAWINGS

FIG. 9 is a side view of a sensing device made according to the present invention.

FIG. 10 is a side view of another sensing device made according to the present invention.

FIG. 11 is a side view of another sensing device made according to the present invention.

DETAILED DESCRIPTION OF THE INVENTION

Figure 1:
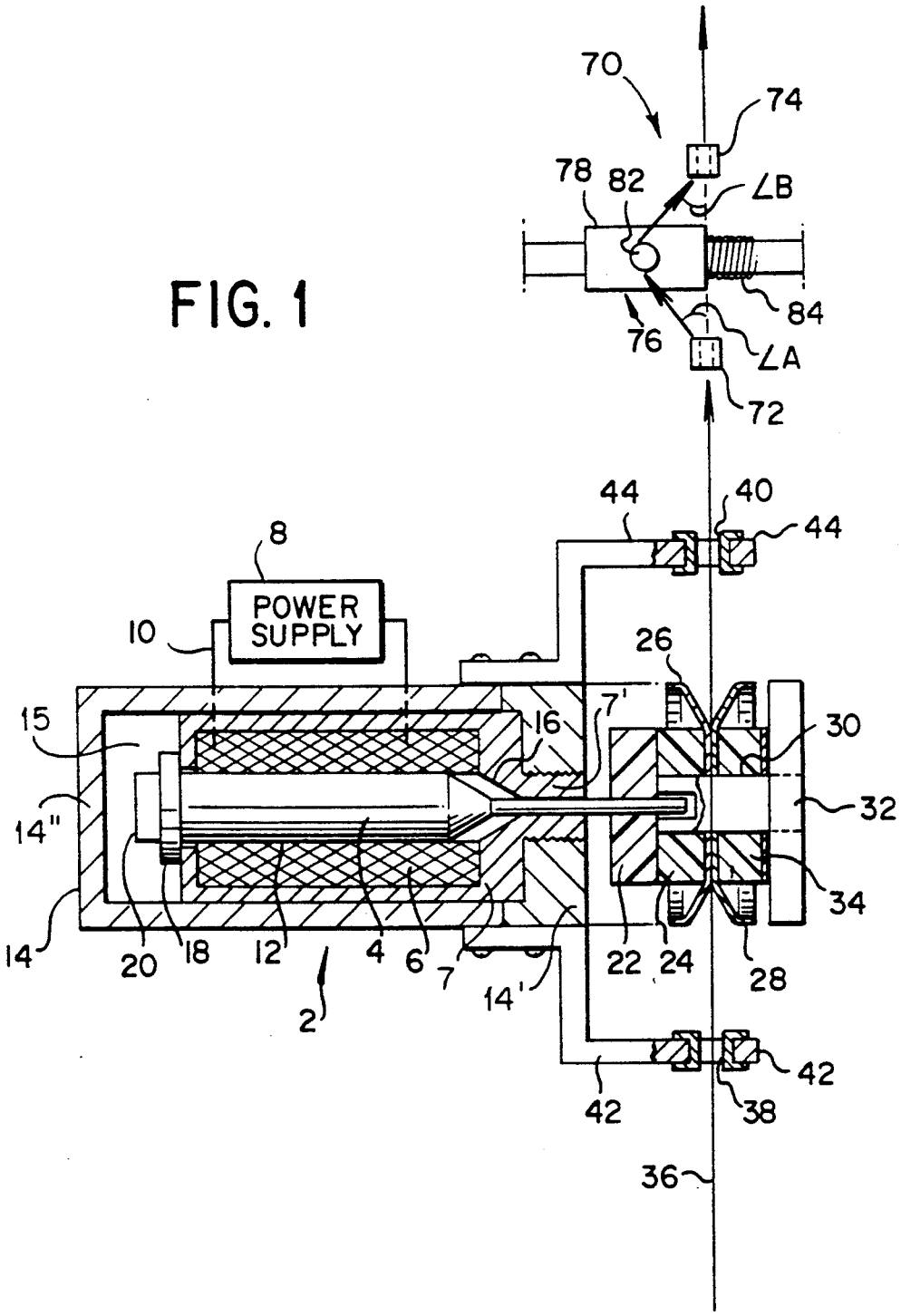
FIG. 1 is a top cross-sectional view of a solenoid used in a yarn tensioning device and sensing device made according to the present invention with some portions of the device shown in diagrammatic form.

As shown in FIG. 1, in a preferred embodiment, a yarn tensioning device of the present invention includes a solenoid 2 of having a plunger 4 located inside a coil 6. Electrical power is supplied by a power supply 8 by electrical wires 10 to coil 6 in order to cause plunger 4 to move inside a channel 12 in a housing 14 which contains coil 6.

Housing 14 preferably includes at least two parts 14', 14". Coil 6 is provided in a casing 7 which preferably includes a threaded portion 7' screwed into housing part 14'. Part 14" of housing 14 is then slipped over coil 6 and attached to part 14' of housing 14. As shown in FIG. 1, housing 14 includes a space 15 which allows plunger 4 to move to the left beyond coil 6.

Plunger 4 is prevented from fully seating against a complementary surface 16 of housing 14, because a stop or spacer 18 attached to the base 20 of the plunger 4 prevents further movement of plunger 4 to the right to prevent eddy currents, especially eddy currents caused by the plunger 4 seating against surface 16, which generate non-linear force characteristics. The position within coil 6 where the movement of plunger 4 is arrested can be adjusted by changing the thickness of stop 18 or changing the location of stop 18 on the plunger. The stop 18 is placed on plunger 4 to arrest the movement of the plunger at a position in coil 6 where the force exerted by the plunger is linear with respect to the electrical power supplied to coil 6. Attached to the other end of plunger 4 is a force exerting washer 22 for exerting force on a another object such as force receiving washer 24 of disc-shaped engaging member 26.

Disc-shaped engaging member 26 and disc-shaped engaging member 28 form a tensioning assembly that is mounted on axle 30 which is fixed to fixed member 32. Fixed member 32 is attached to housing 14 by a bridging portion (not shown) which is spaced from engaging members 26 and 28. Engaging members 26 and 28 are free to rotate around axle 30 and when pressure is not exerted by plunger 4, engaging members 26 and 28 can slide until force receiving washer 24 abuts force exerting washer 22. Force receiving washer 24 may be free from engaging member 26 but is preferably attached to engaging member 26 in order to provide consistent pressure on the yarn to be tensioned and to prevent wear of member 26. Engaging member 28 can also have a washer 34 associated with it which may either be free, attached to engaging member 28, or attached to fixed member 32 to prevent wear of engaging member 28. While the members 26 and 28 are preferably made of a magnetic metal, washers 22, 24 and 34 are preferably made of a non-magnetic material having a low coefficient of friction, such as TEFLON® or DELRIN (both manufactured by DUPONT). The axle 30 is preferably made of a ceramic material. Axle 30 is preferably either hollow or partially hollow so that it can receive the tip of plunger 4.

When plunger 4 exerts force on engaging member 26, members 26 and 28 exert tension on a piece of yarn or filament 36 located between members 26 and 28. For the purposes of the present application, the terms "filament" and "yarn" are used interchangeably. The filament 36 is led in a path between members 26 and 28 by eyes 38 and 40 in arms 42 and 44 of housing 14. For illustration purposes, the path of filament 36 is shown passing between members 26 and 28 in FIG. 1, although in reality filament 36 would pass on one side or the other of axle 30 and, therefore, would not be visible in a cross-sectional view of solenoid 2. Engaging members 26 and 28 are flared or curved away from the path of the yarn as shown.

The solenoid 2 in the yarn tensioning device described is designed so that plunger 4 exerts a force which is linear with respect to the power supplied to coil 6 when the force exerting washer 22 (as well as the tip of plunger 4) is moved to a position where filament 36 is placed under tension by engaging members 26 and 28. Because the force exerted by the plunger is linear with respect to power, the yarn tensioning device of the present invention can be operated with a high degree of sensitivity and can exert low tension levels on the tensioned filament, even when the filament is travelling at high speeds through the device.

While the stop shown in FIG. 1 is attached to the base of the plunger, the stop could be located in a variety of places and could take a variety of forms. For example, a stop can be placed at the opposite end of plunger 4 where the plunger narrows to form the tip. Preferably, when used on the base of a plunger as shown, the stop is non-resilient and has a thickness of about 0.05 to 0.1 inches. A preferred material for the stop is DELRIN. Using a stop of the type shown in FIG. 1, it is possible to adjust the tension on the engaging members so that the members rotate at about 0.01 to 0.1% of the speed of the yarn or filament passing between the members, depending on the speed of the yarn. Because of this slight rotation, lint does not accumulate, so the members are self-cleaning. Also, the strand is not able to cause a wear spot on the inside of the members.

The tensioning device as shown can be used in a commercial yarn tensioning assembly which requires a number of such devices in which a plurality of filaments, preferably arranged in parallel filament paths, are tensioned. In textile manufacturing, such as beaming, up to 1400 ends of yarn are tensioned simultaneously. Typically, all the tensioning devices for all 1400 ends are controlled from one master unit. Due to differences such as friction rates, exit angles, distance, mechanical design variations, etc, no two tensioning devices operate at exactly the same rate.

A major advantage of the filament tensioning devices of the present invention is that when the devices are used together, each of the devices can be adjusted individually and precisely so that a uniform tension can be

BEST AVAILABLE COPY applied to all of the strands passing through a filament tensioning apparatus using the devices. The tension adjustment can be performed manually by using a tensiometer to measure the tension exerted on each filament, comparing the measured tension to the desired tension and then adjusting a pulse width modulation circuit associated with the solenoid to change the tension exerted on the filament. Alternatively, the measurement and adjustment of the tension can be done automatically.

Figure 8:
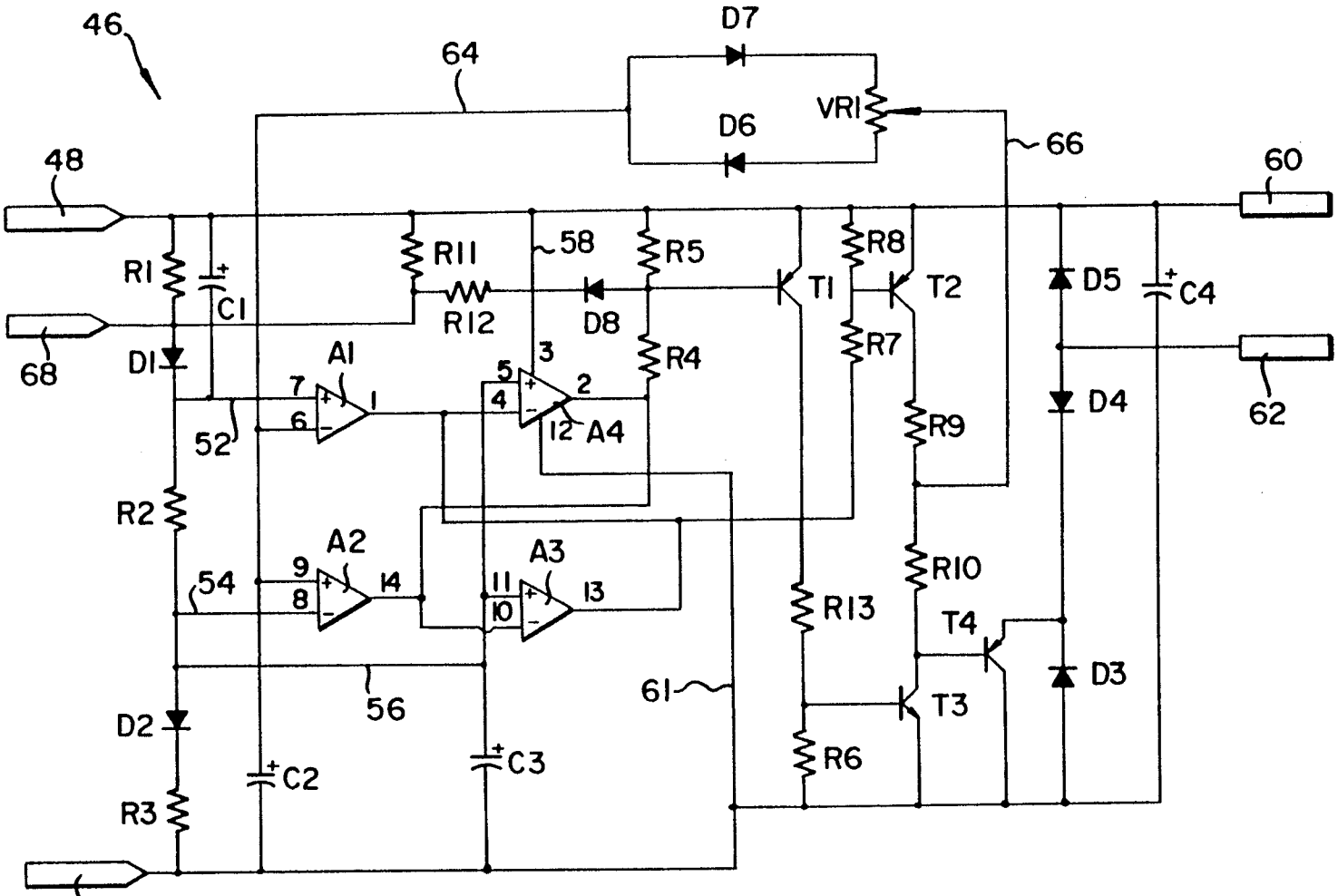
FIG. 8 is a schematic diagram of a pulse width modulation circuit which can be used in a yarn tensioning device of the present invention.

Referring to FIG. 8, a pulse width modulation control circuit 46 is illustrated which can be manually adjusted. The positive and negative terminals of power supply 8 (not shown in FIG. 8) are connected to the circuit 46 by jumpers 48 and 50, respectively. A resistor R1, diode D1, resistor R2, diode D2 and resistor R3 are connected in series between jumpers 48 and 50. The diode D1 is arranged so that the anode of diode D1 is connected to the resistor R1and the cathode of diode D1 is connected to the resistor R2. Similarly, diode D2 has its anode connected to resistor R2 and the cathode connected to resistor R3. In a preferred embodiment, the values of R1, R2, and R3 will each be 22KΩ. A capacitor C1 is connected in parallel with R1 and D1 and preferably has a capacitance of 1 uf. Lead line 52 connects the cathode of diode D1 and the negative terminal of capacitor C1 to the non-inverting terminal of amplifier A1. A lead line 54 has one end electrically connected between resistor R2 and the anode of diode D2 and the other end connected to the inverting terminal of amplifier A2. The inverting terminal of amplifier A1 is electrically connected to the non-inverting terminal of amplifier A2. Additionally, the non-inverting terminal of amplifier A2 is connected to the positive terminal of a capacitor C2 which in turn has its negative terminal connected to the jumper 50. In a preferred embodiment, capacitor C2 will have a capacitance of 0.002 uf. Amplifiers A1 and A2 comprise a window comparator whose inputs are controlled by timing capacitor C2. A lead line 56 has one end connected between resistor R2 and the anode of diode D2 and the other end connected to the non-inverting terminal of amplifier A3. Connected between the non-inverting terminal of amplifier A3 and the jumper 50 is a capacitor C3. In a preferred embodiment, capacitor C3 will be orientated similarly to capacitor C2 and will have a capacitance of 1 uf.

The non-inverting terminal of amplifier A3 is also electrically connected to the non-inverting terminal of amplifier A4. The output of amplifier A2 and amplifier A4 are both connected to the inverting terminal of amplifier A3. In a similar fashion, the output of amplifier A1 and amplifier A3 are electrically connected to the inverting terminal of amplifier A4. Thus, the output from the window comparator is the input to a flip/flop circuit formed by Amplifiers A3 and A4. The timing capacitor C2 is charged and discharged by the output of the flip/flop circuit so that after C2 charges to the upper limit, it discharges through a variable resistor VR1, described below, until C2 reaches the lower limit of the other flip/flop at which time C2 is recharged. Power is supplied to amplifier A4 by lead line 58. Lead line 58 has one end connected to jumper 48 and the other end connected to amplifier A4. A return path is created by lead line 61 which has one end connected to amplifier A4 and the other end connected to jumper 50. The output of amplifier A4 is also connected to jumper 48 via two resistors R4 and R5, each having a preferred resistance of 22KΩ. A PNP transistor T1 has a base which is electrically connected between R4 and R5, the emitter is connected to the voltage supply via jumper 48, and the collector is connected to the power supply 8 by jumper 50. Located between jumper 50 and the collector of T1 are resistors R6 and R13 which each have a preferred resistance of 22KΩ.

In a similar fashion, the output from amplifier A3 is also connected to power supply 8 via jumper 48 with resistors R7 and R8 located between the amplifier A3 and jumper 48. The resistors R7 and R8 will preferably have a value of 22KΩ each. A PNP transistor T2 has a base which is electrically connected between R7 and R8, the emitter is connected to the voltage supply via jumper 48, and the collector is connected to power supply 8 by jumper 50. Located between jumper 50 and the collector of T2 are resistor R9, a resistor R10, and a NPN transistor T3. In a preferred embodiment, the collectors of transistors T2 and T3 are connected and have resistors R9 and R10 located therebetween.

The emitter of T3 is connected to jumper 50 and the base of T3 is connected between R13 & R6. Thus, the output of the flip/flop drives the transistors T1, T2, T3 and T4 and enables a variable duty cycle at a constant frequency.

A PNP transistor T4 has a base which is connected to the collector of transistor T3, before resistor R10, a collector which is connected to jumper 50 and an emitter which is connected to the cathode of diode D3. The anode of diode D3 is connected to the power supply 8 via jumper 50 and to the solenoid high jumper 60 via capacitor C4. In a preferred embodiment, capacitor C4 will have a capacitance of 1000 uf and will also be connected to jumper 48 at the positive terminal. The cathode of diode D3 is also connected to the cathode of diode D4. The anode of diode D4 is connected to both the solenoid low jumper 62 and the anode of flyback diode D5. The cathode of flyback diode D5 is connected to the solenoid high jumper 60 and jumper 48. Thus, flyback diode D5 maintains the current to the solenoid during the off time of the duty cycle.

A lead line 64 is connected to the inverting terminal of amplifier A1 at one end and is connected to two diodes D6 and D7. In a preferred embodiment, diodes D6 and D7 are arranged with opposite polarities, i.e., line 64 is connected to the cathode of diode D6 and the anode of diode D7. A variable resistor or timing potentiometer VR1 is connected between the cathode of diode D7 and the anode of diode D6. A lead line 66 connects the variable resistor wiper terminal to a point in the circuit between resistor R9 and resistor R10. Thus, the two diodes D6 and D7 allow different resistances to charge and discharge the timing capacitor C2. This allows the duty cycle to be changed while maintaining the same frequency.

The control circuit 46 is also provided with an override control input signal, via full on jumper 68, to temporarily (for the length of the signal) override the modulation created by circuit 46 and thus allow the solenoid to receive maximum power for braking and beaming processes. The override is provided by connecting jumper 68 to jumper 50. Located in series between jumpers 68 and 60 is a resistor R11 having a preferred value of 4.7KΩ. An isolation resistor R12 and diode D8 are also provided. In a preferred embodiment, R12 will have a resistance of 22KΩ and will be connected to jumper 68 at one end and to diode D8 at the other. Diode D8 is orientated so that the cathode is connected to resistor R12 and the anode is connected between resistors R4 and R5.

In pulse width modulation circuit 46 there are two distinct logical outputs, one from amplifier A3 and one from amplifier A4. The output from amplifier A3 triggers transistor T2 to conduct. The output from amplifier A4 triggers transistor T1 to conduct and either T1 or T2 will be conducting and thus generate a positive or negative voltage at jumper 62. By being able to control the duration of the negative voltage exerted on jumper 62 and thus to solenoid 2, the duty cycle of the solenoid 2 may be accurately controlled from a value between 5–95%. Thus if the tension is too great, the duty cycle is reduced, thus reducing the tension upon the filament 36. Likewise, if the tension is too little, the duty cycle can be increased, thus increasing the tension upon the filament 36.

In operation, there are a plurality of the above described control circuits 46, one for each solenoid 2. The circuit varies the current to solenoid 2 by varying the duty cycle using the potentiometer VR1. The solenoid 2 is driven by a constant voltage which is switched on and off so that the ratio of the on time compared to the off time determines the current through the coil 6. By adjusting the duty cycle of each solenoid 2, the tension on each yarn or filament 36 may be independently maintained at a predetermined value.

Figure 12:
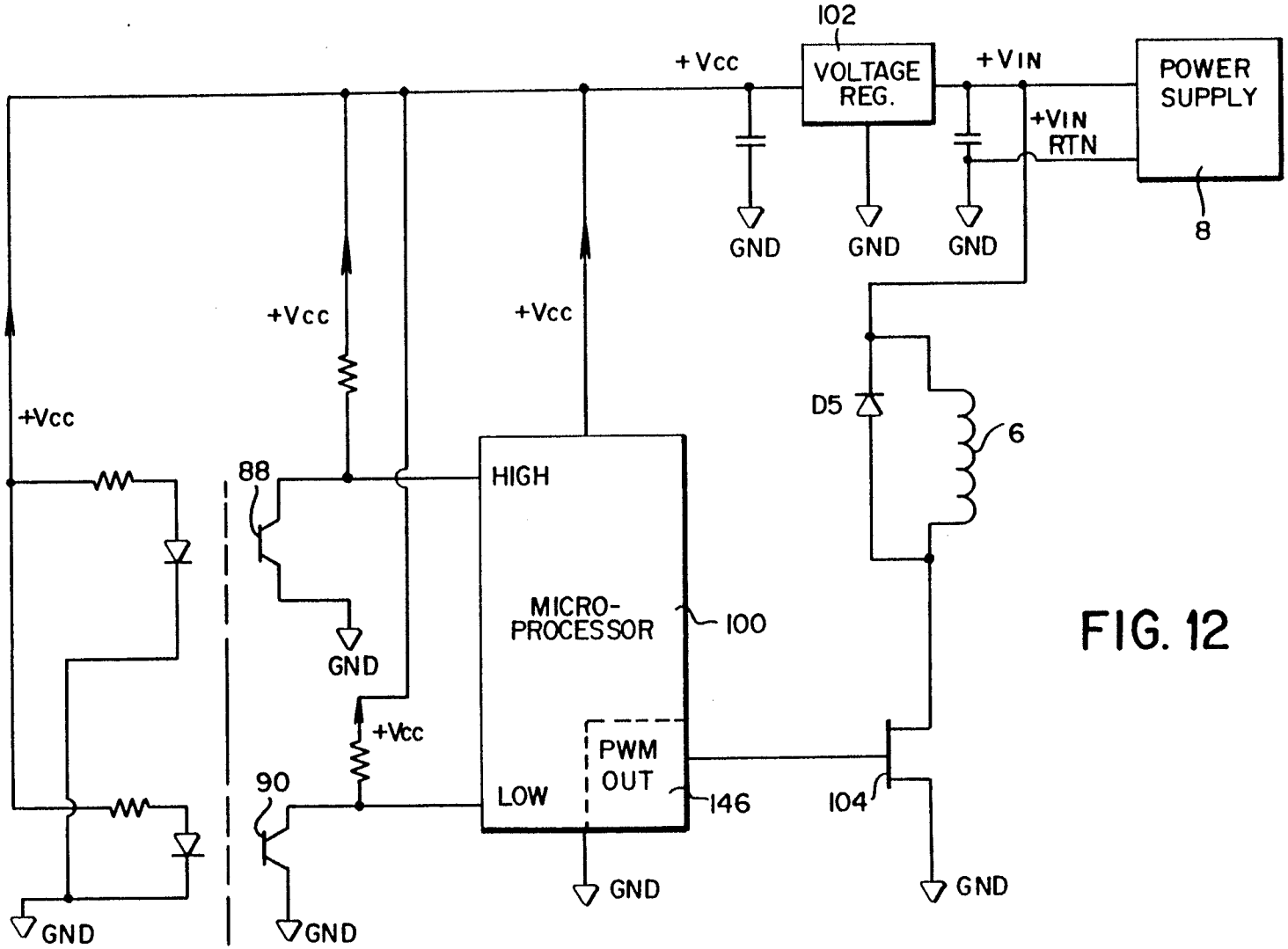
FIG. 12 is a schematic of a control circuit of the present invention.
Figure 13:
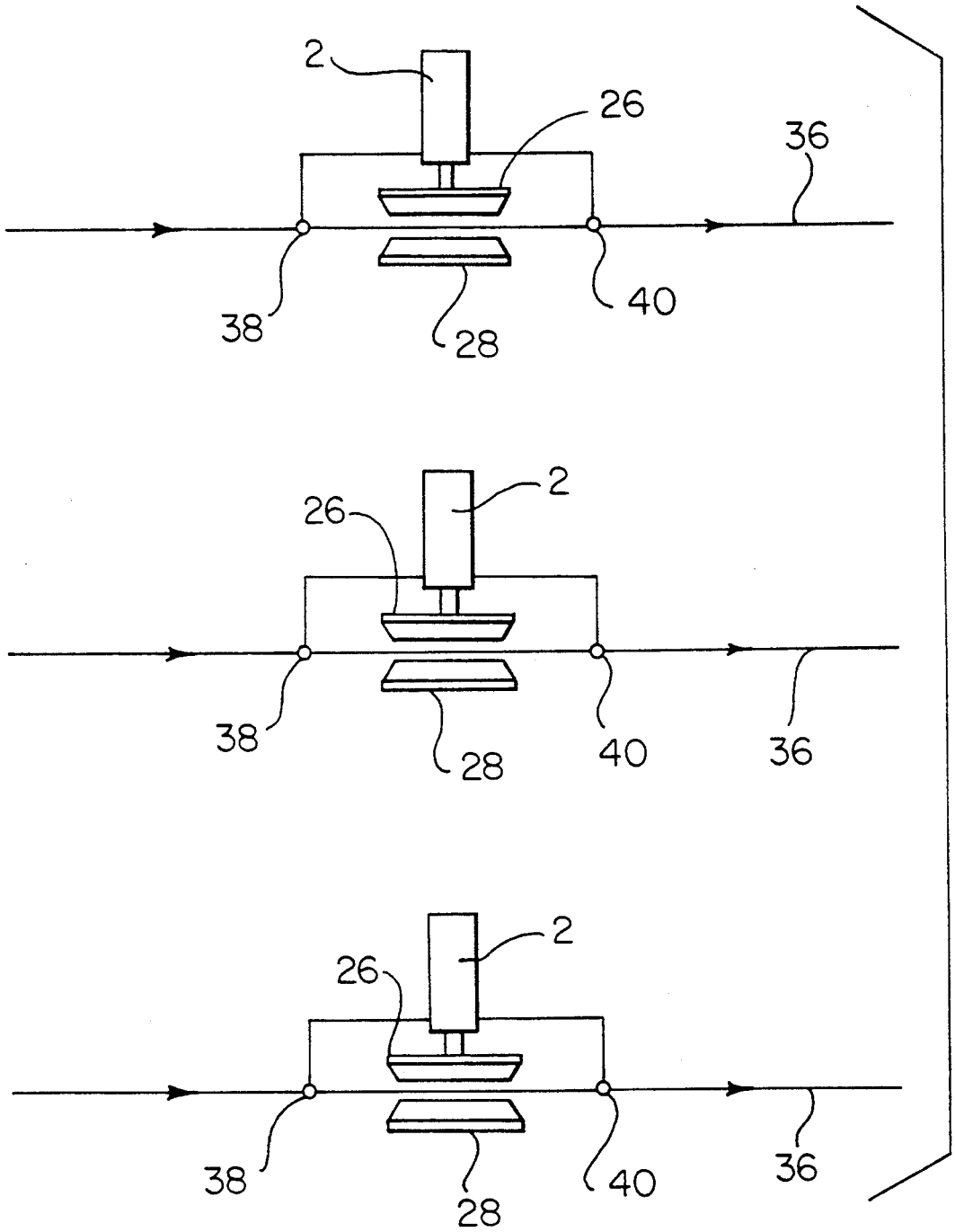
FIG. 13 is a diagrammative view of apparatus comprising a plurality of filament tensioning devices according to the invention.

A control circuit which is self-adjusting is shown in FIG. 12. Power supply 8 in addition to supplying power to coil 6 of solenoid 2 also powers a microprocessor 100. A preferred microprocessor is a type 80C552. The voltage to microprocessor 100 is maintained at 5 volts by a voltage regulator 102. Microprocessor 100 includes a pulse width modulation circuit 146 which is similar to the pulse width modulation circuit 46 shown in FIG. 8.

When the tension on the yarn increases or decreases, infrared sensor 88 or infrared sensor 90 is activated, respectively, and an appropriate error signal is sent to microprocessor 100. The infrared sensors 88 and 90 are part of a sensing device 70 located downstream on the yarn path from disc-shaped engaging members 26 and 28 in FIG. 1.

Based on the error signal received, microprocessor 100 automatically adjusts pulse width modulation circuit 146 to increase or decrease the value of the pulse width or band which energizes the coil/solenoid by switching on or off the logic level of N Channel MOSFET 104 which functions similarly to the combination of transistors T3 and T4 and diode D3 in FIG. 8. The value of the pulse width is then maintained until new error signals are received by microprocessor 100. Although only one solenoid is shown being controlled by microprocessor 100 in FIG. 12, it is possible to control any number of solenoids.

Although conventional yarn tension measuring or sensing devices can be used in the yarn tensioning device of the present invention, a preferred tension sensing device 70, shown in FIG. 1, includes two yarn guides 72 and 74, a slide mechanism 76 and one or more infrared sensors (not shown in FIG. 1). One embodiment of the slide mechanism 76 is illustrated in FIG. 9 in which sliding assembly 78 slides on a shaft 80. After passing through a yarn guide 72, the yarn slides around a smooth post or pulley 82 and then through a yarn guide 74.

Preferably pulley 82 is free to rotate as the yarn slides around pulley 82. When the yarn slides around pulley 82, pulley 82 and the attached sliding assembly 78 are pulled from left to right and exert a force on a spring 84 helically surrounding shaft 80. The entrance angle A and the exit angle B of the yarn when it enters and exits sensing device 70 are chosen to be sufficiently great to exert a force on sliding assembly 78 capable of bringing sliding assembly 78 to a rest position between infrared sensors 88 and 90. However, the angles A and B should not be so great that the yarn passing around pulley 82 exert too much drag. The sliding assembly 78 is shown at rest in FIG. 9 with no yarn exerting a force on sliding assembly 78.

Preferably, when yarn is under a desired tension, the spring 84 will be about 50% compressed by sliding assembly 78. When the yarn is under too much tension, a fin or pin 86 on sliding assembly 78 will move to the right from the desired tension position and will interfere with infrared sensor 88, thereby causing sensor 88 to send a signal to a control circuit (not shown in this drawing figure). The tension exerted on the yarn can be determined from the location of the infrared sensor 88 and the compressibility of the spring. If the tension on the yarn is less than the desired tension, the sliding assembly 78 and attached pin 86 will move to the left from the desired tension position and pin 86 will interfere with the second infrared sensor 90, thereby causing sensor 90 to send a signal to the control circuit. By increasing number of infrared sensors used, it is possible to increase the precision of the measurement of the distance sliding assembly 78 has moved, and, thereby, determine the tension exerted on the yarn tensioner with greater precision. In addition to pin 86, sliding assembly 78 can include a second fin or pin 92 as shown which interacts with additional sensors (not shown) to provide even more precise measurements of the distance sliding assembly 78 has moved.

If the desired tension on the yarn changes, spring 84 can be replaced with a different spring that will have a compression of about 50% at the desired tension.

A second embodiment of the slide mechanism is shown in FIG. 10. In this embodiment, sliding assembly 178 slides on two shafts 180 and 181 and exerts force on two springs 185. Like the sliding assembly shown in FIG. 9, sliding assembly 178 includes a pulley 82 and pins 86 and 92. Because sliding assembly 178 slides on two poles 184 and 185, it slides more evenly than sliding assembly 78. Because the yarn which pulls horizontally on pin 82 also has a tendency to pull and rotate the portion of the sliding assembly closest to the spring downward onto the rod, the addition of a second shaft improves the ability of the sliding assembly to move smoothly by reducing the ability of the sliding assembly to rotate downward. The second shaft also stabilizes the assembly in an upright position.

FIG. 11 illustrates a third embodiment of a sliding assembly 178 made according to the present invention. In this embodiment, a pulley 282 is located within an opening 294 in sliding assembly 278. Opening 294 allows yarn being tensioned to pass through sliding assembly 278 and to pull on pulley 282. Because pulley 282 is preferably located near the center of mass of sliding assembly 278, locating pulley 282 within opening 294 not only allows sliding assembly 278 to be moved smoothly with the pull of the yarn, but makes calculations of the tension exerted by the yarn more precise. When the pin is located on top of the sliding assembly, error is introduced in tension measurements because the yarn acts on the sliding assembly at a point above the center of mass of the sliding assembly.

Whatever its configuration, sensing device 70 sends a error signal to the control circuit which controls the tension exerted by the yarn tensioning device. Each tensioning device and associated sensing device may have its own control circuit, such as the one illustrated in FIG. 8, or the sensing devices may send their signals to a central control circuit or computer which controls all of the tensioning devices. Because there is a sensing device for each tensioning device, it is possible to independently adjust each of the tensioning devices to a desired tension using either separate control circuits or a central control device such as a computer.

The solenoid of the present invention will now be described with reference to the following examples:

EXAMPLE 1

Tests were run on a solenoid similar to the solenoid shown in FIG. 1. The test solenoid included a ⅞" coil and a 0.05" stop, and exerted force (mass) versus power measurements were made when the plunger was at various points within the coil. The results of these trials are shown below and in the graph of FIG. 2. The distances in the table are the distance from the base of the plunger to the end of the narrower portion of the coil. The solenoid is designed for a 100% duty cycle.

| 2.165" Mass | Power | 2.215" Mass | Power | 2.260" Mass | Power | 2.315" Mass | Power |
|---|---|---|---|---|---|---|---|
| 100 g | 0.46 W | 50 g | 0.52 W | 50 g | 0.88 W | 50 g | 1.3 W |
| 125 g | 0.57 W | 100 g | 1.1 W | 100 g | 1.9 W | 100 g | 2.9 W |
| 150 g | 0.66 W | 150 g | 1.6 W | 150 g | 2.9 W | 150 g | 4.5 W |
| 200 g | 0.93 W | 200 g | 2.3 W | 200 g | 3.9 W | 200 g | 5.9 W |
| 300 g | 1.3 W | 300 g | 3.5 W | 300 g | 5.7 W | 300 g | 8.8 W |
| 400 g | 1.8 W | 400 g | 4.8 W | 400 g | 7.9 W | 400 g | 7.9 W |
| 500 g | 2.3 W | 500 g | 5.8 W | | | | |
| 600 g | 2.64 W | 600 g | 7.0 W | | | | |

Figure 2:
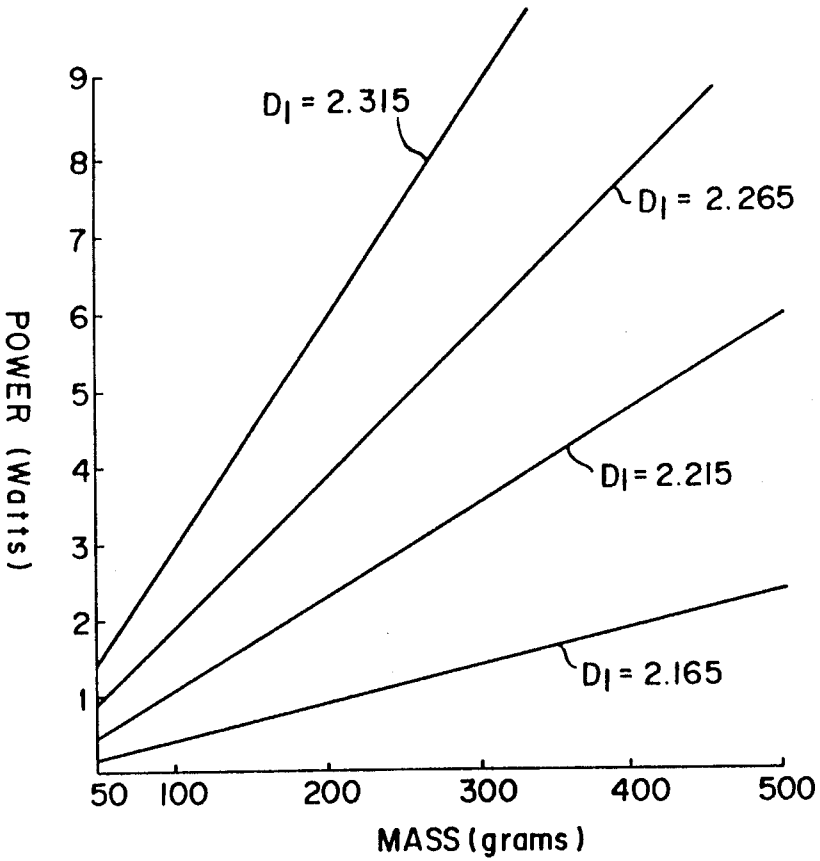
FIG. 2 shows graphs of power versus force when the distance the plunger tip extends from a solenoid according to the present invention is held constant.

As can be seen in FIG. 2, force is linearly related to power when the plunger is at a fixed distance within the coil.

Figure 3:
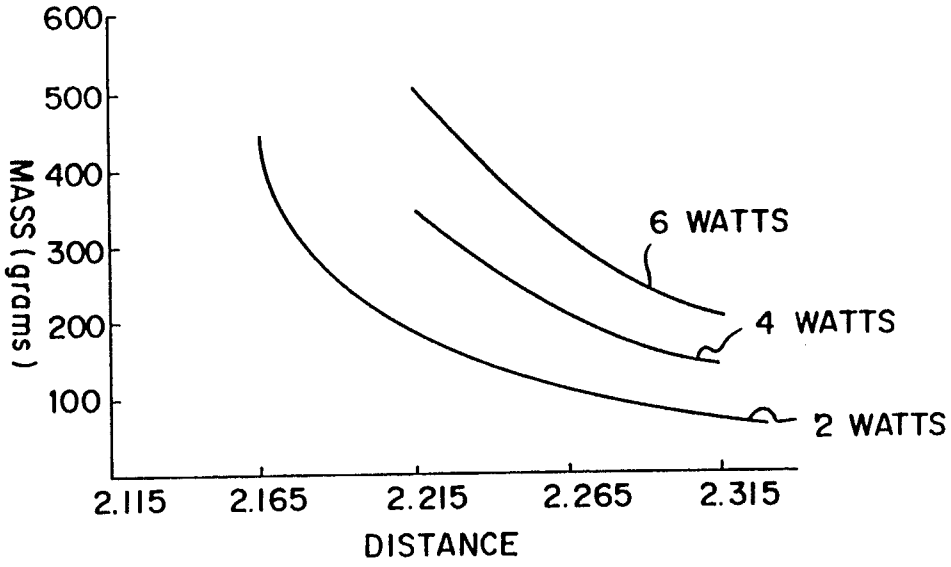
FIG. 3 is a graph of force versus distance for a given amounts of power supplied to the solenoid of FIG. 2.

In contrast, force is not linear with respect to distance for a given amount of power as shown by the graph in FIG. 3.

EXAMPLE 2

Tests were run on a solenoid similar to the solenoid shown in FIG. 1. The test solenoid had a ⅞" coil and a 0.05" stop. Exerted force (mass) versus power measurements were made when the plunger was at various points inside the coil. The results of these trials are shown below and in the graph of FIG. 4. The distances in the table are the distance from the base of the plunger to the end of the narrower portion of the coil. The solenoid is designed for a 100% duty cycle.

| 2.70" Mass | Power | 2.75" Mass | Power | 2.80" Mass | Power | 2.315" Mass | Power | 3.0" Mass | Power |
|---|---|---|---|---|---|---|---|---|---|
| 50 g | 0.17 W | 50 g | 0.33 W | 50 g | 0.5 W | 50 g | 0.90 W | 50 g | 1.5 W |
| 100 g | 0.37 W | 100 g | 0.73 W | 100 g | 1.1 W | 100 g | 2.0 W | 100 g | 3.2 W |
| 150 g | 0.58 W | 150 g | 1.1 W | 150 g | 1.7 W | 150 g | 3.1 W | 150 g | 4.9 W |
| 200 g | 0.77 W | 200 g | 1.6 W | 200 g | 2.4 W | 200 g | 4.3 W | 200 g | 6.7 W |
| 300 g | 1.2 W | 300 g | 2.4 W | 300 g | 3.6 W | 300 g | 6.5 W | 300 g | 10.9 W |
| 400 g | 1.6 W | 400 g | 3.3 W | 400 g | 4.9 W | 400 g | 8.6 W | | |
| 500 g | 2.1 W | 500 g | 4.1 W | 500 g | 6.0 W | | | | |
| 600 g | 2.5 W | 600 g | 4.9 W | 600 g | 7.2 W | | | | |
| 700 g | 3.0 W | 700 g | 5.6 W | 700 g | 8.6 W | | | | |

Figure 4:
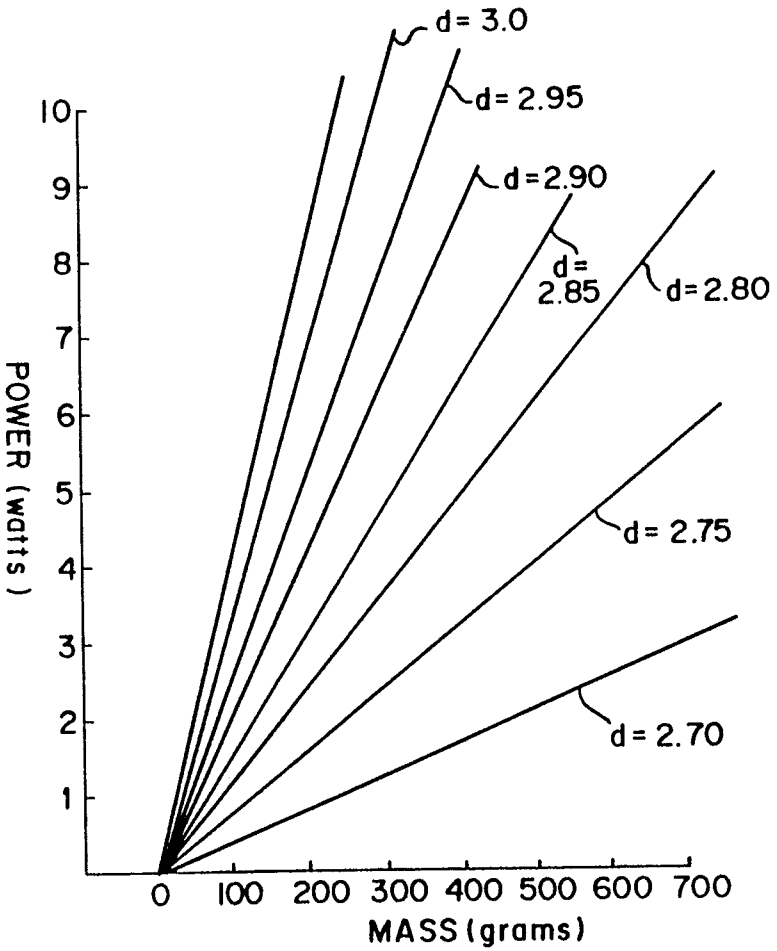
FIG. 4 shows graphs of power versus force when the distance the plunger tip extends from a solenoid according to the present invention is held constant.

As can be seen in FIG. 4, force is linearly related to power when the plunger is at a fixed distance within the coil.

Figure 5:
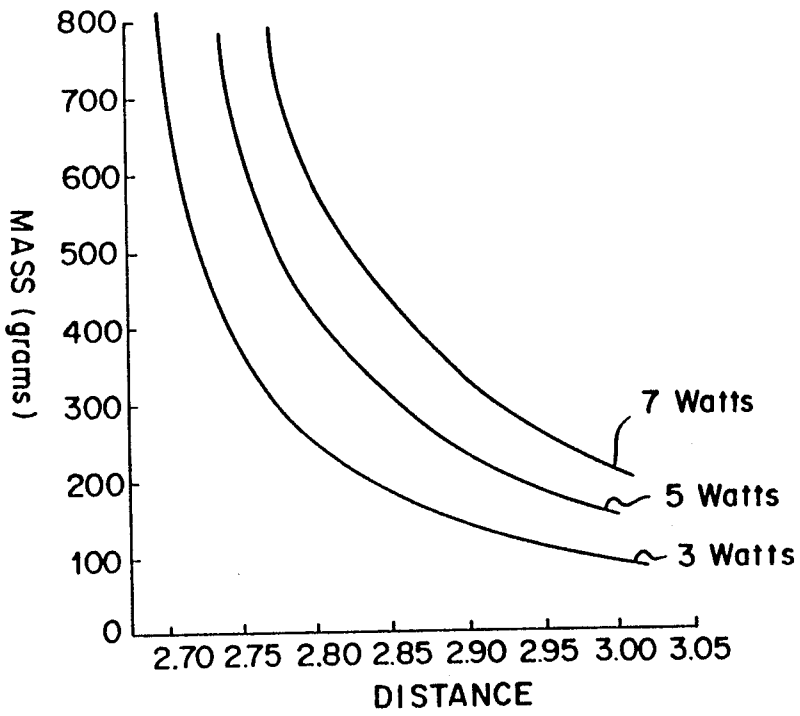
FIG. 5 shows graphs of force versus distance for given amounts of power supplied to the solenoid of FIG. 4.

In contrast, force is not linear with respect to distance as shown by the graph in FIG. 5.

Figure 7:
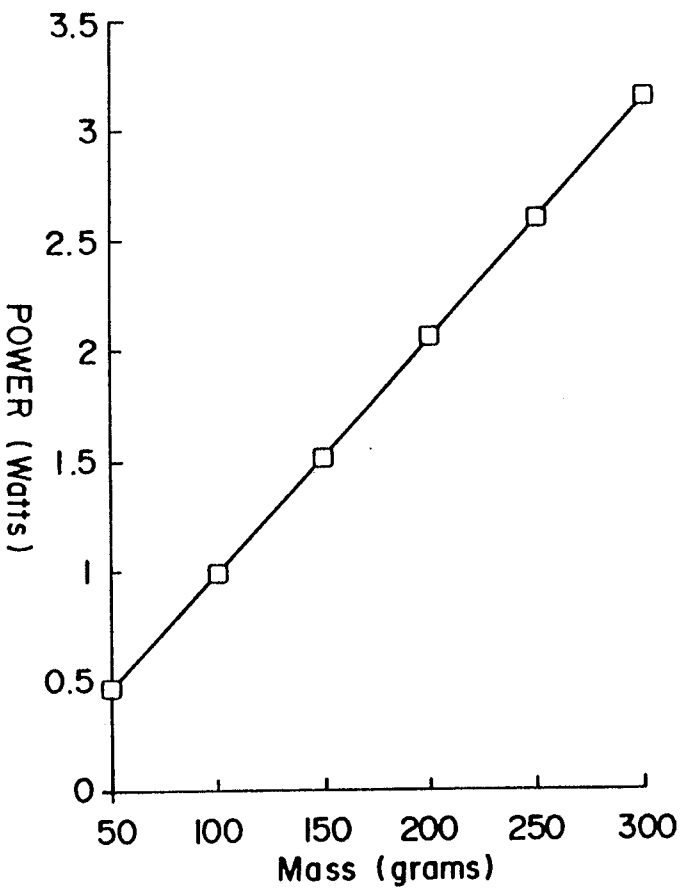
FIG. 7 shows a graph of power versus force for various solenoids according to the present invention in which each solenoid includes a plunger stop of a given thickness.
Figure 6:
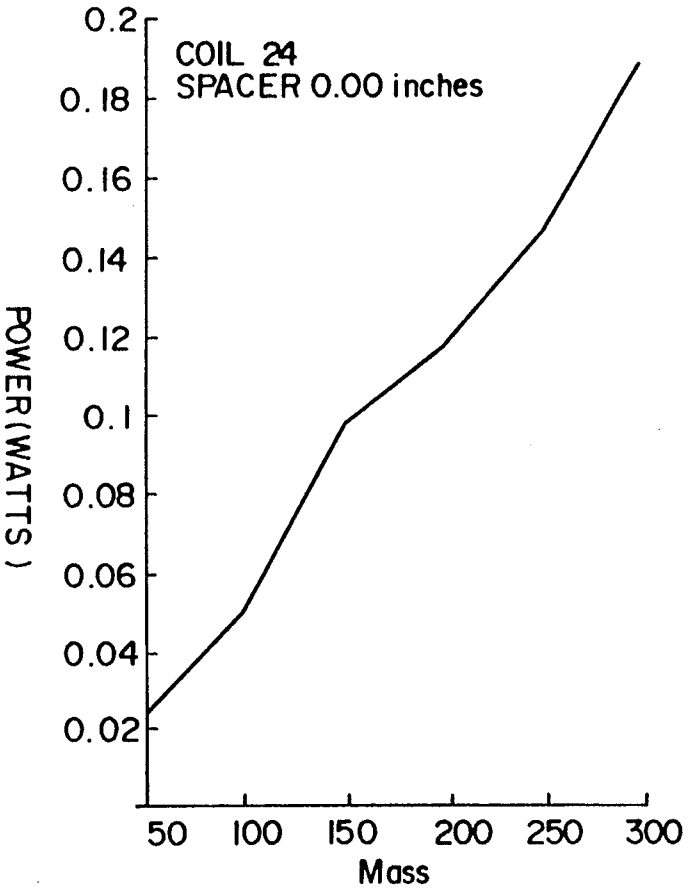
FIG. 6 shows a graph of power versus force for prior art solenoid that does not include a stop.

The degree to which the relationship between power and force is linear in solenoids made according to the present invention can be seen in FIGS. 6 and 7. FIG. 6 shows a prior art solenoid that does not include a stop where the graph of power versus force varies significantly from linearity. In contrast, the power versus force graphs are noticeably more linear for the solenoids in FIG. 7 which are made according to the present invention with a 0.100" thick stop attached to each of their plungers. A greater power is used to achieve the same exerted force as the non-arrested solenoid.

Although this invention has been described in its preferred forms with a certain degree of particularity, it is to be understood that the present disclosure of the preferred forms has been made only by way of example and that numerous changes in details of construction and combination and arrangement of parts may be resorted to without departing from the spirit and scope of the invention as hereinafter claimed.

What is claimed is:

1. A control circuit for controlling the duration of the duty cycle of a solenoid based upon the tension exerted on a filament, said circuit comprising:

a power supply;

means for generating a reference current signal corresponding to a given tension upon a filament;

means for measuring the tension exerted on said filament;

means for generating a measured tension current signal based on the measured tension exerted on said filament;

means for generating an error signal corresponding to the difference between said reference current signal and said measured tension current signal; and means for incrementing or decrementing said duty cycle of said solenoid based upon said error signal.

2. A control circuit according to claim 1, wherein said means for incrementing or decrementing said duty cycle includes means for selectively allowing an electrical connection between said power supply and said solenoid.

3. A control circuit according to claim 1, wherein said means for establishing a reference current comprises a variable resistor.

4. A control circuit according to claim 3, wherein the resistance of said variable resistor is controlled by a computer controller.

5. A control circuit according to claim 1, wherein said means for generating a measured tension current signal includes a transducer.

6. A control circuit according to claim 1, wherein said means for incrementing or decrementing comprises four amplifiers, the output of first of said amplifiers being combined with the output of a second of said amplifiers to provide an input to an inverting terminal of a third of said amplifiers, and the output of said third of said amplifiers being combined with the output of a fourth of said amplifiers to provide an input to an inverting terminal of said first of said amplifiers;

two output terminals, the first corresponding to an increment of the duty cycle and the second corresponding to a decrement of the duty cycle;

a first transistor for receiving an output current from said third of said amplifiers and providing selective electrical connection to said first terminal; and a second transistor for receiving an output current from said first of said amplifiers and providing selective electrical connection to said second terminal.

7. A control circuit according to claim 1, wherein said circuit includes a bypass means for allowing a continuous connection of said power supply to said solenoid and thus generating a 100% duty cycle for said solenoid.

8. A control circuit according to claim 7, wherein said bypass means comprises a terminal for connecting said power supply to said solenoid;

a first diode for isolating said power supply from said means for generating an error signal;

an output terminal corresponding to an increment of the duty cycle; and a second diode placed between said output terminal and said means for generating an error signal for isolating said power supply from said means for generating an error signal.

9. Filament tensioning apparatus for tensioning a plurality of filaments comprising, a plurality of filament tensioning devices, each said filament tensioning device including, means for guiding the movement of a filament in a discrete filament path, tensioning means for placing the filament under tension, said tensioning means including a solenoid for exerting tension on the filament, a control circuit for controlling the duration of the duty cycle of said solenoid based upon the tension exerted on said filament, said circuit comprising:

a power supply;

means for generating a reference current signal corresponding to a given tension upon said filament;

means for measuring the tension exerted on said filament;

means for generating a measured tension current signal based on the measured tension exerted on said filament;

means for generating an error signal corresponding to the difference between said reference current signal and said measured tension current signal; and means for incrementing or decrementing the duty cycle of said solenoid based upon said error signal.

10. A filament tensioning apparatus according to claim 9, wherein said means for incrementing or decrementing the duty cycle of said solenoid comprise a microprocessor.

11. A method for tensioning a plurality of filaments comprising:

moving a plurality of filaments in respective discrete filament paths;

activating a plurality of solenoids to exert force on a plurality of respective tensioning means which in turn apply tension to a respective one of said plurality of filaments;

measuring the tension on each of said plurality of filaments;

comparing the measured tension on each of said filaments with a reference tension; and incrementing or decrementing the duty cycle of each of said solenoids based upon the difference between the measured tension on a respective filament and the reference tension to thereby adjust the tension exerted on each of said filaments.

* * * * *